US009891570B2

(12) United States Patent
Furukawa

(10) Patent No.: US 9,891,570 B2
(45) Date of Patent: Feb. 13, 2018

(54) IMAGE FORMING DEVICE, IMAGE FORMING SYSTEM, AND IMAGE FORMING METHOD

(71) Applicant: KONICA MINOLTA, INC., Chiyoda-ku, Tokyo (JP)

(72) Inventor: Hiroshi Furukawa, Saitama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/063,344

(22) Filed: Mar. 7, 2016

(65) Prior Publication Data

US 2016/0299463 A1 Oct. 13, 2016

(30) Foreign Application Priority Data

Apr. 10, 2015 (JP) ..... 2015-081285

(51) Int. Cl.
*G03G 15/00* (2006.01)

(52) U.S. Cl.
CPC ..... *G03G 15/6529* (2013.01); *G03G 15/55* (2013.01); *G03G 15/6517* (2013.01); *G03G 15/6558* (2013.01)

(58) Field of Classification Search
CPC ..... G03G 15/6588
USPC ..... 399/388
See application file for complete search history.

(56) References Cited

U.S. PATENT DOCUMENTS 5,036,359 A * 7/1991 Duijve ..... G03G 15/047 242/559.2
5,130,724 A * 7/1992 Crowley ..... B65H 5/025 271/10.01
5,553,809 A * 9/1996 Oku ..... B65H 16/00 242/534.1
7,628,465 B2 12/2009 Aruga
8,223,394 B2 7/2012 Yamamoto
(Continued)

FOREIGN PATENT DOCUMENTS

JP 04182243 A 6/1992
JP 2006188352 A 7/2006
(Continued)

OTHER PUBLICATIONS

Japanese Office Action (and English translation thereof) dated Apr. 26, 2017 issued in counterpart Japanese Application No. 2015-081285.

(Continued)

*Primary Examiner* — Anthony Ngyuen
(74) *Attorney, Agent, or Firm* — Holtz, Holtz & Volek PC

(57) ABSTRACT

There are included an image forming unit for forming an image on continuous paper, a continuous paper conveying unit for conveying the continuous paper, and a control unit for controlling the image forming unit and the continuous paper conveying unit, wherein, after conveyance is started by the continuous paper conveying unit in printing preparation and before printing is started, the control unit is enabled to perform meandering prevention approach control of stabilizing conveyance of continuous paper that is being conveyed, and allows switching between performance and non-performance of the meandering prevention approach control and/or changing a level of the meandering prevention approach.

20 Claims, 9 Drawing Sheets

(56) References Cited

U.S. PATENT DOCUMENTS

| | | | | |
|---|---|---|---|---|
| 8,528,901 | B2 | 9/2013 | Yamada | |
| 2005/0219292 | A1* | 10/2005 | Koike | B41J 3/28 347/14 |
| 2006/0177253 | A1* | 8/2006 | Aiko | G03G 15/6567 399/394 |
| 2007/0014585 | A1* | 1/2007 | Nagasu | G03G 15/2028 399/67 |
| 2007/0277693 | A1* | 12/2007 | Drexler | G03G 15/50 101/485 |
| 2007/0291060 | A1 | 12/2007 | Aruga | |
| 2008/0007800 | A1 | 1/2008 | Yamamoto | |
| 2008/0285994 | A1* | 11/2008 | Tamura | G03G 15/1615 399/66 |
| 2009/0278303 | A1* | 11/2009 | Fuwa | B65H 23/038 271/225 |
| 2014/0063163 | A1* | 3/2014 | Kanemoto | B65H 23/0326 347/104 |

FOREIGN PATENT DOCUMENTS

| | | | |
|---|---|---|---|
| JP | 2007279362 | A | 10/2007 |
| JP | 2008000903 | A | 1/2008 |
| JP | 2008009297 | A | 1/2008 |
| JP | 2008102410 | A | 5/2008 |
| JP | 2010201682 | A | 9/2010 |
| JP | 2013246316 | A | 12/2013 |

OTHER PUBLICATIONS

Chinese Office Action dated Oct. 25, 2017 issued in counterpart Chinese Application No. 201610209722.7.

* cited by examiner

IMAGE FORMING DEVICE, IMAGE FORMING SYSTEM, AND IMAGE FORMING METHOD

CROSS-REFERENCE TO RELATED APPLICATIONS

The present application claims priority under 35 U.S.C. §119 to Japanese Patent Application No. 2015-081285, filed Apr. 10, 2015. The contents of this application are incorporated herein by reference in their entirety.

BACKGROUND OF THE INVENTION

Field of the Invention

The present invention relates to an image forming device, an image forming system, and an image forming method which enable printing on continuous paper.

Description of the Related Art

In the case of an image forming device that uses continuous paper, the continuous paper sometimes meanders at the time of start of printing, and a user possibly cannot obtain a desired printing result. There is a technique for preventing meandering of paper by reading the position of a paper edge by a sensor and by detecting occurrence of meandering (see Japanese Patent Laid-Open No, H4-182243). This technique relates to a printing device for avoiding meandering which possibly occurs within several seconds from the start of printing. Specifically, paper edge position data is transmitted from a device for detecting a paper edge position to a meandering alarm detector, and when meandering is detected, travelling of the paper is stopped and an alarm is displayed. Furthermore, the paper edge position data of a stable travelling state is learned, and erroneous detection is prevented by comparing the paper edge position at the time of stable travelling and the paper edge position in the current state.

There is also a technique of conveying paper for a while before start of printing, and of starting printing after checking that paper is conveyed without meandering.

Furthermore, there is proposed a printer provided with a paper feed mechanism which is capable of reliably creating a balanced state between the left and right conveying forces of paper feed rollers and paper pressing rollers in the width direction of recording paper (see Japanese Patent Laid-Open No. 2010-201682).

According to the paper feed mechanism of a roll paper printer of the printer, thanks to an automatic alignment action around a fulcrum of a pressing lever and adjustment of a spring hook position of a tension coil spring, the paper pressing roller supported by the pressing lever is pressed against the paper feed roller in such a way that the pressing force is uniform along each part in the width direction, and the paper feed force on recording paper from the paper feed roller and the paper pressing roller is made balanced between the left and the right of the recording paper in the width direction, and meandering/oblique travelling/jamming of the recording paper is prevented.

However, according to the technique proposed by Japanese Patent Laid-Open No. H4-182243, when meandering occurs, the device is stopped, and the production efficiency is poor, and no measures are taken to solve the meandering.

On the other hand, according to the technique for solving meandering by conveying paper for a while, it is necessary to check that paper is conveyed without meandering, and the work efficiency is poor.

Furthermore, the technique proposed by Japanese Patent Laid-Open No. 2010-201682 merely intends to reduce the frequency of occurrence of meandering, and does not indicate a method of dealing with meandering once it occurs.

The present invention has been made in view of the circumstances described above, and has its object to provide an image forming device, an image forming system, and an image forming method which enable efficiently preventing meandering of continuous paper at the time of start of conveyance.

SUMMARY OF THE INVENTION

To achieve at least one of the abovementioned objects, an image forming device reflecting one aspect of the present invention includes an image forming unit for forming an image on continuous paper, a continuous paper conveying unit for conveying the continuous paper, and a control unit for controlling the image forming unit and the continuous paper conveying unit, wherein, after conveyance is started by the continuous paper conveying unit in printing preparation and before printing is started, the control unit is enabled to perform meandering prevention approach control of stabilizing conveyance of continuous paper that is being conveyed, and allows switching between performance and non-performance of the meandering prevention approach control and/or changing a level of the meandering prevention approach.

In the image forming device according to the abovementioned aspect, it is preferable that a time when printing is to be started is at or later than a printing start allowable allowable time that is a time when a conveying speed of the continuous paper conveying unit reaches a predetermined speed.

In the image forming device according to the abovementioned aspect, it is preferable that the meandering prevention approach control is control of continuing conveyance of continuous paper for a predetermined period of time.

In the image forming device according to the abovementioned aspect, it is preferable that the meandering prevention approach control is control of continuing conveyance of continuous paper until it is determined, in determination regarding continuous paper meandering, that meandering prevention is not necessary.

In the image forming device according to the abovementioned aspect, it is preferable that the control unit performs the meandering prevention approach control based on a meandering prevention approach setting.

In the image forming device according to the abovementioned aspect, it is preferable that a conveyance condition including at least one of a type of a job, a type of continuous paper, and basis weight, and an approach operation content regarding conveyance by an meandering prevention approach are associated with each other in the meandering prevention approach setting.

In the image forming device according to the abovementioned aspect, it is preferable that, in the meandering prevention approach setting, depending on a conveyance condition, a content regarding a continuous paper conveyance distance for performing conveyance by the meandering prevention approach is set as an approach operation content.

In the image forming device according to the abovementioned aspect, it is preferable that, in the meandering prevention approach setting, a continuous paper conveyance distance for performing conveyance by the meandering prevention approach is set according to a thickness of continuous paper, and a content is set such that the continuous paper conveyance distance is small for relatively thick continuous paper and the continuous paper conveyance distance is great for relatively thin continuous paper.

In the image forming device according to the abovementioned aspect, it is preferable that the meandering prevention approach setting includes a conveyance condition according to which conveyance by the meandering prevention approach is not performed.

In the image forming device according to the abovementioned aspect, it is preferable that, in a case where a conveyance condition is sample printing, the control unit does not perform conveyance by the meandering prevention approach or lessens conveyance by the meandering prevention approach.

In the image forming device according to the abovementioned aspect, it is preferable that the control unit performs machine adjustment during a period of the meandering prevention approach control.

In the image forming device according to the abovementioned aspect, it is preferable that, in a case of a condition according to which the machine adjustment is to be performed during the meandering prevention approach control, if the machine adjustment cannot be completed during the period of the meandering prevention approach control, the control unit does not perform the machine adjustment during the period of the meandering prevention approach control, and performs the machine adjustment after the meandering prevention approach is ended.

In the image forming device according to the abovementioned aspect, it is preferable that the control unit does not perform machine adjustment regarding a position of continuous paper and a position of image forming during conveyance by the meandering prevention approach.

In the image forming device according to the abovementioned aspect, it is preferable that the image forming device includes an operation display unit for receiving an operation input, and the control unit includes a function of performing the meandering prevention approach control based on an approach operation content set by the operation display unit.

In the image forming device according to the abovementioned aspect, it is preferable that the image forming device includes an operation display unit for receiving an operation input, wherein the control unit allows setting, by the operation display unit, regarding performance/non-performance of conveyance by the meandering prevention approach.

In the image forming device according to the abovementioned aspect, it is preferable that the control unit starts printing after performing conveyance by the meandering prevention approach.

To achieve at least one of the abovementioned objects, an image forming system reflecting one aspect of the present invention includes a control unit for controlling an image forming unit for forming an image on continuous paper and a continuous paper conveying unit for conveying the continuous paper along a conveying path, wherein, after conveyance is started by the continuous paper conveying unit in printing preparation and before printing is started, the control unit is enabled to perform meandering prevention approach control of stabilizing conveyance of continuous paper that is being conveyed, and allows switching between performance and non-performance of the meandering prevention approach control and/or changing a level of the meandering prevention approach.

In the image forming system according to the abovementioned aspect, it is preferable that the image forming system includes:

an image forming unit for forming an image on continuous paper; and a continuous paper conveying unit for conveying the continuous paper along a conveying path.

To achieve at least one of the abovementioned objects, an image forming method reflecting one aspect of the present invention is an image forming method of performing printing on continuous paper, the method including:

causing conveyance of continuous paper to be started in printing preparation; and performing meandering prevention approach for stabilizing conveyance of continuous paper that is being conveyed, after conveyance of the continuous paper is started and before printing is started, wherein switching between performance and non-performance of the meandering prevention approach and/or changing of a level of the meandering prevention approach is allowed to be performed.

DETAILED DESCRIPTION OF THE PREFERRED EMBODIMENTS

Hereinafter, an embodiment of the present invention will be described with reference to the appended drawings.

Figure 1:
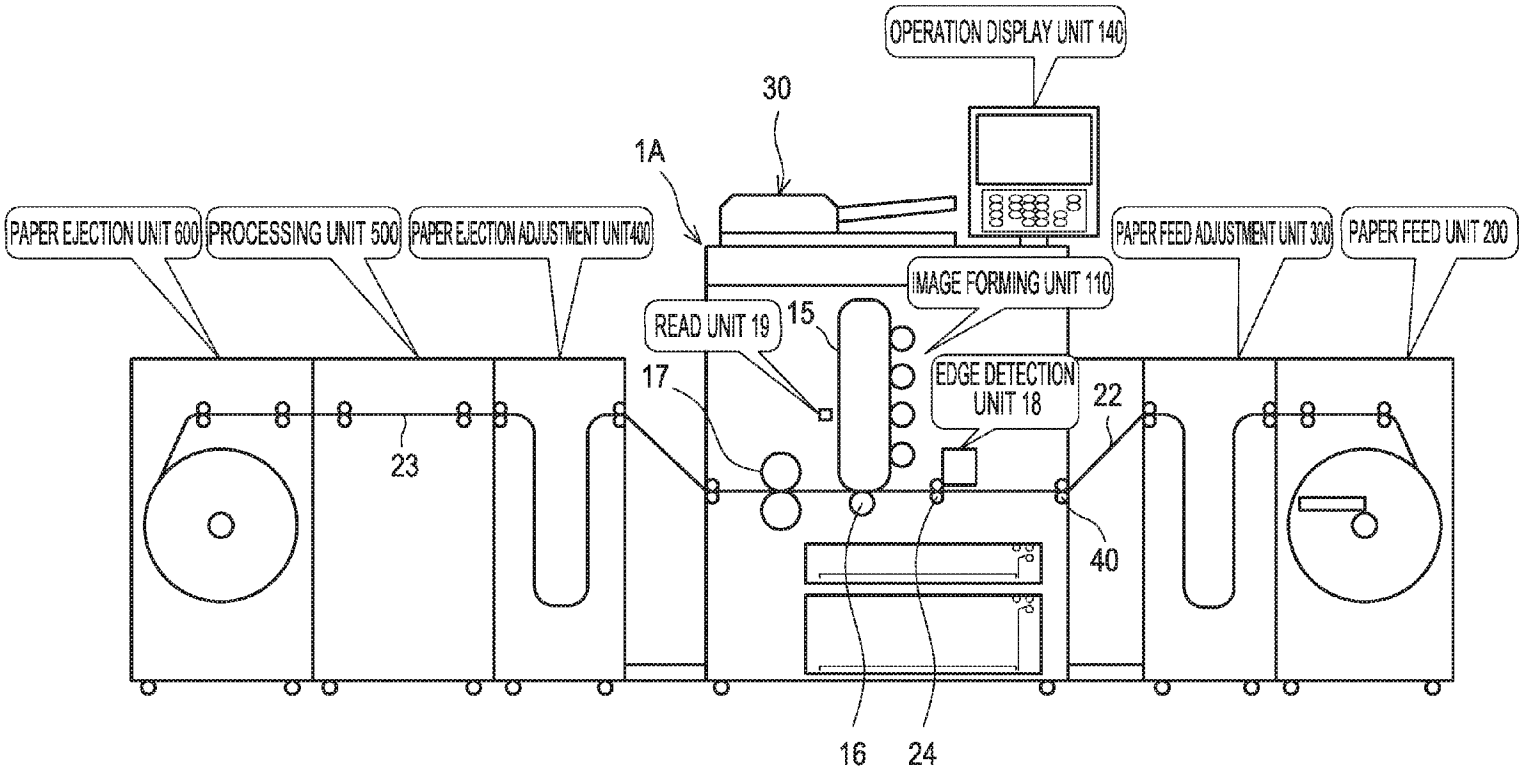
FIG. 1 is a diagram showing a mechanical overview of an image forming device according to an embodiment of the present invention.

FIG. 1 shows an image forming device according to an embodiment of the present invention.

An image forming device 1 includes a device main body 1A provided with an image forming unit, and a paper feed adjustment unit 300 is connected before the device main body 1A, and a paper feed unit 200 is connected before the paper feed adjustment unit 300. Also, a paper ejection adjustment unit 400 is connected on the paper ejection side of the device main body 1A, a processing unit 500 is connected on the paper ejection side of the paper ejection adjustment unit 400, and a paper ejection unit 600 is connected on the ejection side of the processing unit 500.

Additionally, in the present embodiment, description is given assuming that the image forming device 1 is configured by the device main body 1A and devices connected to the device main body 1A, but the types and numbers of devices to be connected to the device main body 1A are not particularly limited, and it is also possible to configure the image forming device only by the device main body 1A. In this case, the device main body 1A possibly configures an image forming system together with other devices.

The paper feed unit 200 has a function of accommodating, holding and feeding roll paper as continuous paper. The paper feed adjustment unit 300 has a buffer function for absorbing minute speed difference between the paper feed unit 200 and the device main body 1A, and wrinkling. The paper ejection adjustment unit 400 has a buffer function for absorbing minute speed difference between the processing unit 500 and the device main body 1A, and wrinkling. The processing unit 500 has a function of performing post-processing, such as shape cut out or laminate processing, on roll paper. The paper ejection unit 600 has a function of holding ejected roll paper.

Additionally, in the present embodiment, roll paper is used as the continuous paper, but the continuous paper is not limited to roll paper, and includes a continuous voucher form, a continuous ledger sheet and the like as long as the paper is continuous. The continuous paper is possibly provided in the form of roll paper, or in a folded form.

The image forming device 1 includes, inside the device main body 1A, an image forming unit 110 for forming an image on paper, and includes, on top of the device main body 1A, an operation display unit 140 for receiving operation by a user and for displaying information. The operation display unit 140 is allowed to have an operation unit for performing operation and a display unit for performing display configured in a separate manner, or to have the operation unit and the display unit configured in an integrated manner, as in the case of a touch panel LCD.

Furthermore, a document read unit 30 including an automatic document feed device that automatically reads a document is provided on top of the device main body 1A of the image forming device 1, and an image of a document is read by the document read unit 30 and is temporarily recorded in an image memory or the like, not shown. The image that is read is used for forming of an image by the image forming unit 110.

The image forming device 1 includes a conveying path 22, which extends from the paper feed unit 200 to the paper feed adjustment unit 300 and the image forming unit 110, and moreover, from the image forming unit 110 to the paper ejection adjustment unit 400.

The conveying path 22 is for feeding and conveying paper, and includes a plurality of rollers such as conveying rollers 40. Also, a resist unit is provided the conveying path 22, on the front side of secondary transfer roller 16 in the conveying direction, and the resist unit is configured by a pair of upper and lower resist rollers 24. An edge detection unit 18 is disposed, on the conveying path 22, near and on the downstream side (front side) of the resist rollers 24. Additionally, the installation position of the edge detection unit 18 is not limited thereto, and the edge detection unit 18 is to be installed at an appropriate position on the conveying path 22, and it is also possible to install a plurality of edge detection units 18. The edge detection unit 18 reads edge positions of paper in the width direction by using an optical sensor or the like.

Roll paper accommodated in each paper feed unit 200 is fed by the conveying path 22, and the roll paper is conveyed to the secondary transfer roller 16 via the conveying rollers 40 and the resist rollers 24.

Also, the image forming device 1 includes a conveying path 23, which extends from the paper ejection adjustment unit 400 to the processing unit 500, and moreover, from the processing unit 500 to the paper ejection unit 600.

In the present embodiment, the conveying paths 22 and 23, the conveying rollers 40, the resist rollers 24, a motor, not shown, for driving the rollers to rotate, and the like configure a continuous paper conveying unit of the invention of the present application.

The image forming unit 110 includes photoconductors prepared for respective colors (cyan, magenta, yellow, black, etc.), and a charger, a write unit and a development unit, which are not shown, are arranged in the periphery of each photoconductor. Image exposure is performed by the write unit, such as an LD, on the surface of a photoconductor which is charged by the charger, based on image information of a document recorded in the image memory or the like, and a latent image is formed on the surface of the photoconductor. The latent image is developed into a toner image by the development unit. The toner image is transferred to an intermediate transfer belt 15, and the image on the intermediate transfer belt 15 is transferred to paper that is conveyed by the conveying path 22 and that is conveyed by the secondary transfer roller 16 while being compressed. Additionally, a color image forming device including photoconductors for respective colors and the intermediate transfer belt 15 is described as the present invention, but the image forming device of the present invention can also be a monochrome image forming device.

Furthermore, in the image forming unit 110, a cleaning unit, not shown, for contacting with a photoconductor and removing residual toner is arranged for each photoconductor, on the rotation direction side of a contact position of the intermediate transfer belt and on the counter-rotation direction side of the charger. Also, another cleaning unit, not shown, for removing residual toner on the intermediate transfer belt 15 is arranged on the rotation direction side of a paper transfer position of the intermediate transfer belt 15 and on the counter-rotation direction side of a transfer position of the photoconductor.

Additionally, each of the photoconductors described above is driven and rotated by a drive motor, not shown, and the intermediate transfer belt 15 is also driven and rotated by a drive motor, not shown.

Furthermore, a read unit 19 for reading a pattern or a patch for adjustment formed on the intermediate transfer belt 15 is installed near the intermediate transfer belt 15, on the downstream of a transfer position of the secondary transfer roller 16.

Paper on which an image is transferred by the secondary transfer roller 16 has the toner image on the paper fused, by being compressed and conveyed by a fusing roller of a fusing unit 17 and by application of heat and pressure, and is ejected outside the device with its face up in one-side mode.

Figure 2:
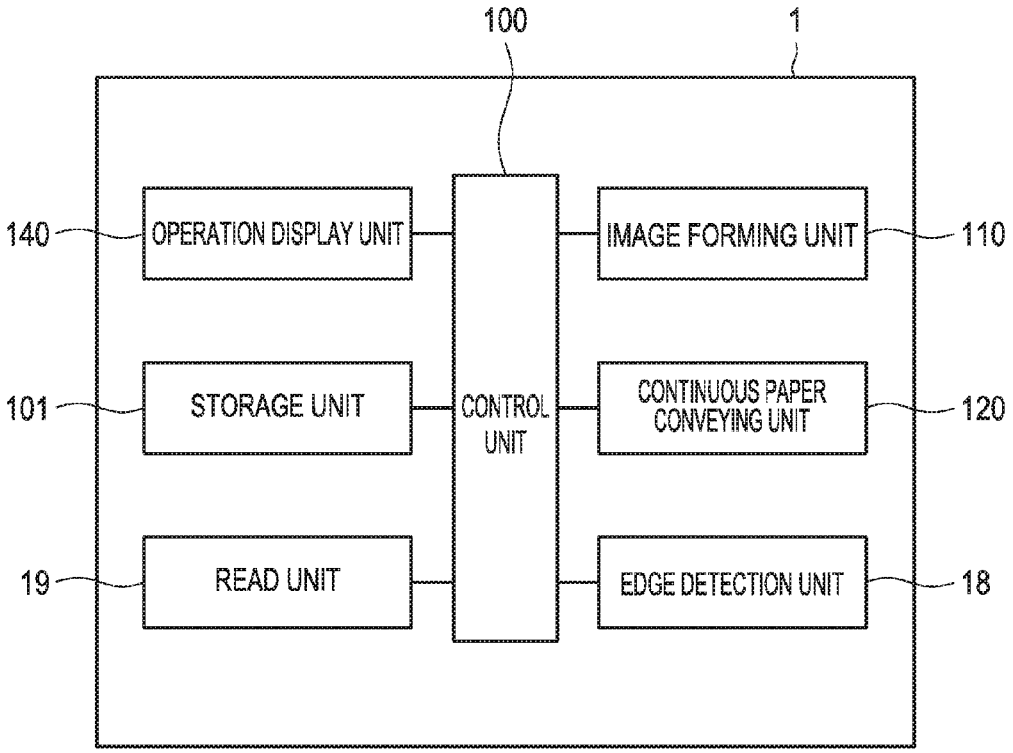
FIG. 2 is a diagram likewise showing an electrical block diagram.

Next, FIG. 2 is a block diagram showing an electrical configuration of the image forming device of the present invention. Description is given below.

The image forming device 1 includes a control unit 100. The control unit 100 can be configured from a CPU and a program for operating the same.

A storage unit 101 is connected to the control unit 100. The storage unit 101 can be configured by a RAM, a non-volatile memory or the like. The RAM can be used as a work area or for storing image data.

A non-volatile memory can store setting data of the image forming device 1, a process control parameter, and the like.

As the setting data, ON/OFF of meandering prevention approach control, automatic/manual for meandering prevention approach control ON, meandering prevention approach setting associating a conveyance condition and an approach operation content, meandering prevention approach setting for only approach operation content, contents of machine setting that can be executed at the time of meandering prevention approach, and the like are stored. Operation contents (main output, sample printing, etc.), paper conditions (type of paper, basis weight), and the like are stored as conveyance conditions, and meandering prevention approach OFF, the approach distance at the time of meandering prevention approach ON, a parameter for calculating the approach distance, and the like are stored as the approach operation contents. The setting data can be made changeable through the operation display unit 140.

The control unit 100 is for controlling the entire image forming device 1, and for grasping the state of the entire image forming device, and performs image forming control, continuous paper conveyance control and the like.

The image forming unit 110 is connected to the control unit 100 in a manner allowing control. At the image forming unit 110, image forming is performed by an electronic photographic process, and an image is transferred to continuous paper.

A continuous paper conveying unit 120 is connected to the control unit 100 in a manner allowing control. As described above, the continuous paper conveying unit 120 is configured by the conveying paths 22 and 23, the conveying rollers 40, the resist rollers 24, a motor, not shown, for driving rollers to rotate, and the like.

Furthermore, the operation display unit 140 is connected to the control unit 100 in a manner allowing control. The operation display unit 140 includes a touch panel LCD for operation and display. That is, input of operation control conditions such as operation instructions, settings of the image forming device, and the like is possible at the operation display unit 140. For example, it is possible to issue an operation instruction for performing meandering prevention approach conveyance automatically or manually, an operation instruction regarding approach operation content for when "manual" is set, and the like.

Moreover, the edge detection unit 18 is connected to the control unit 100 in a manner allowing control. A detection result of edge positions of continuous paper by the edge detection unit 18 is transmitted to the control unit 100, and whether roll paper is meandering or not is determined.

Furthermore, the read unit 19 is connected to the control unit 100 in a manner allowing control. A read result of the read unit 19 is transmitted to the control unit 100, and is used to adjust the image forming unit 110.

Additionally, in the present embodiment, the control unit 100 is described as being installed inside the housing of the device main body 1A, but the control unit 100 can alternatively be provided outside the housing of the device main body 1A. Moreover, it is also possible to control the image forming device by providing a control unit to a management device or the like which is connected to the image forming device by a cable or a network. In this case, the image forming system is configured by the management device and the like, and the image forming device and the like are allowed to be included in the image forming system.

Next, the basic operation of the image forming device 1 will be described.

The control unit 100 controls the image forming unit 110 at the time of execution of printing. At the image forming unit 110, a toner image is written on each photoconductor based on image data, and the toner image written on each photoconductor is transferred to the intermediate transfer belt 15, and then the toner image is secondary-transferred to roll paper that is supplied by the paper feed unit 200, and the image is fused by the fusing unit 17. The roll paper on which the image is formed is conveyed by the conveying path 23 to the paper ejection adjustment unit 400, and is subjected to post-processing at the processing unit 500 further downstream. The roll paper which has passed through the processing unit 500 is rolled up by a roll at the paper ejection unit 600.

Furthermore, at each photoconductor, after a toner image is transferred to the intermediate transfer belt 15, the residual toner is removed by the cleaning unit. Also at the intermediate transfer belt 15, the residual toner is removed by the cleaning unit after the toner image is transferred to paper.

In the case of forming an image of a pattern or a patch for adjustment, the image is transferred to the intermediate transfer belt 15, and the pattern or the patch is read by the read unit 19 without secondary transfer by the secondary transfer roller 16 being performed, and the pattern or the patch is transmitted to the control unit 100. The control unit 100 analyzes the image from the read result, and performs feedback for adjustment of the image forming unit 110.

Figure 3:
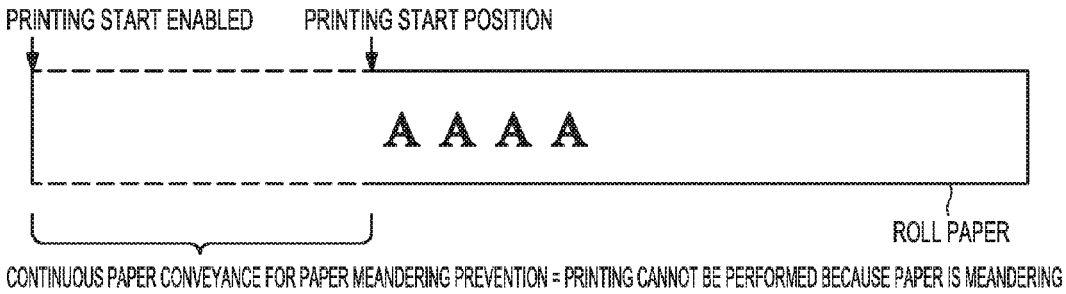
FIG. 3 is a diagram likewise showing a printed state of roll paper where meandering prevention approach is used.

Furthermore, in the case of starting conveyance of continuous paper in printing preparation, printing is allowed to be started once the conveying speed of continuous paper reaches a predetermined speed, which is taken as a printing start allowable time. However, as shown in FIG. 3, conveyance of continuous paper is not stable immediately after start of conveyance, and if meandering may be present, the image quality is reduced. Moreover, in the case of performing a cut-out process at the processing unit 500, cut-out is performed along the contour of a printed image, but if the paper is meandering, the cut-out position and the image are shifted from each other, and cut-out along the contour cannot be performed accurately. Accordingly, in the case of using continuous paper, it is necessary to perform conveyance for a certain distance before printing so as to prevent, meandering of paper (hereinafter "meandering prevention approach"), and to start printing after meandering is settled and conveyance becomes stable.

In the present embodiment, the control unit 100 has a function of meandering prevention approach conveyance, and is capable of performing meandering prevention approach conveyance control based on setting. According to meandering prevention approach conveyance, meandering prevention approach conveyance is ended and printing is started when meandering is determined to have been settled according to a detection result of the edge detection unit 18, for example, but in the present embodiment, meandering prevention approach can be performed by continuing continuous paper conveyance for an approach distance that is based on a set approach operation content. By continuing continuous paper conveyance by meandering prevention approach, meandering may be settled and a stable state may be achieved.

Switching of whether control of performance/non-performance of meandering prevention approach is to be performed in an "automatic" manner or in a "manual" manner is made possible. In the case where "manual" is set, selection to "not perform" the meandering prevention approach, and selection of an approach distance from "1 m", "3 m", "4 m" and the like are made possible. Since the necessary approach distance is different depending on the type of paper/basis weight (thickness of paper), a user is allowed to select the setting. In the case where a user determines that the meandering prevention approach is not necessary, as in the case of sample printing, the meandering prevention approach is set to "manual"—"not perform", and printing can be started without performing the meandering prevention approach. Also in the case of performing adjustment printing, printing can be performed without performing the meandering prevention approach for other than the items which cannot be adjusted if the paper is meandering (such as positioning).

Figure 4:
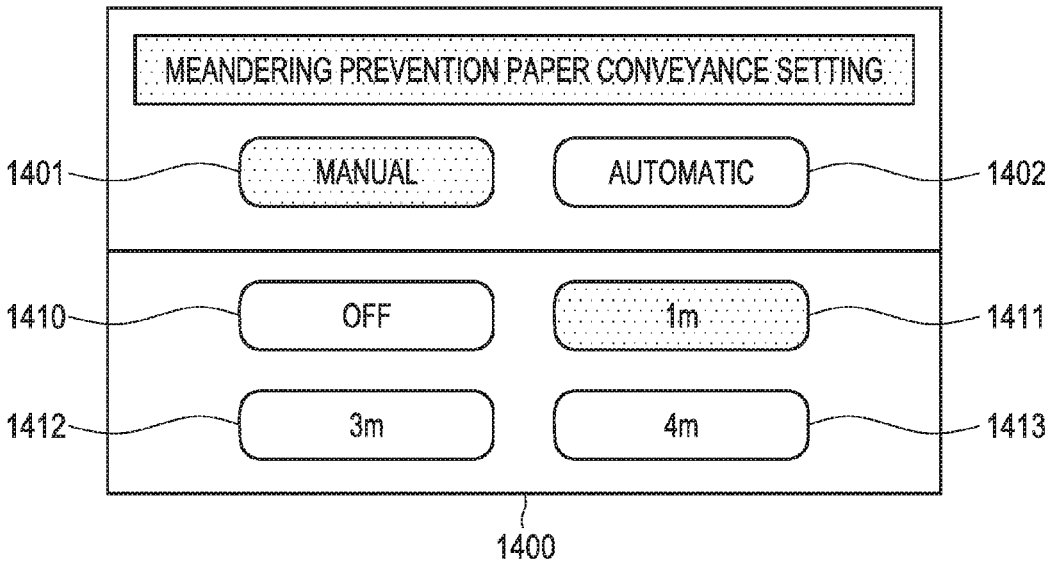
FIG. 4 is a diagram likewise showing an example of a state where manual setting is selected on a meandering prevention approach setting screen.
Figure 5:
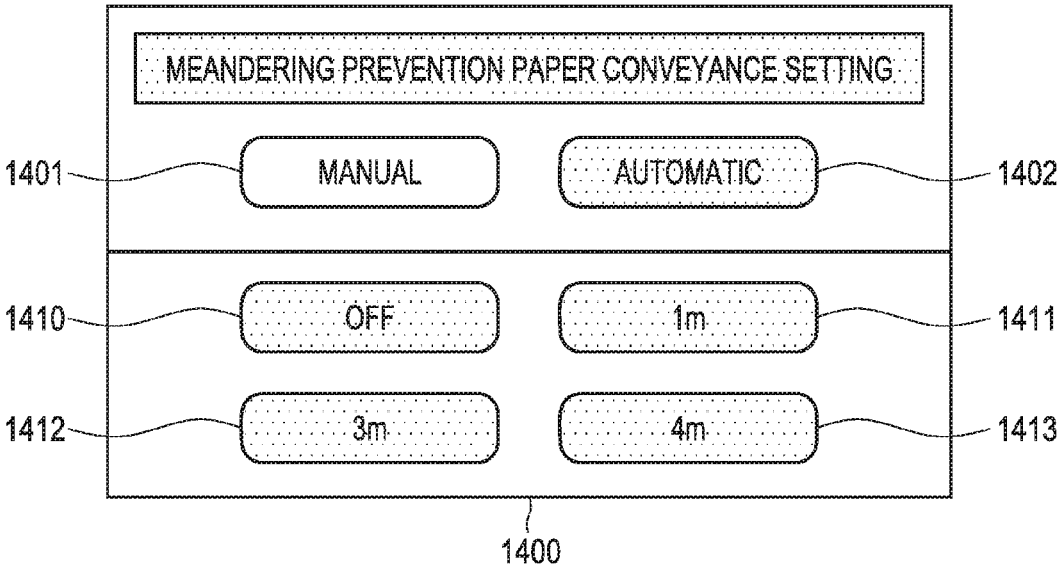
FIG. 5 is a diagram likewise showing a state where automatic setting is selected on the meandering prevention approach setting screen.

FIGS. 4 and 5 show a meandering prevention approach setting screen 1400 displayed on the operation display unit 140.

On the meandering prevention approach setting screen 1400, a manual button 1401 and an automatic button 1402 are displayed in the upper section in a manner allowing pressing, and selection of one of them is made possible. An initial setting where one is already selected is also possible.

An "OFF" button 1410, a "1 m" button 1411, a "3 m" button 1412, and a "4 m" button 1413 which can be pressed when the manual button 1401 is selected are displayed in the lower section on the meandering prevention approach setting screen 1400. Selection of only one of the buttons in the lower section is allowed. A selected button is displayed in a highlighted manner. When a button is pressed in a state where another button is already selected, content of the previous button is cancelled, and the content of the new button is set. The "1 m" button 1411, the "3 m" button 1412, and the "4 m" button 1413 are for setting the distance for which the continuous paper is to be conveyed by meandering prevention approach conveyance after when printing on the continuous paper becomes possible. Printing of a job is started after the continuous paper is conveyed by the distance. With the "OFF" button 1410, printing is started when printing becomes possible, without performing meandering prevention approach conveyance.

An instruction regarding the content of meandering prevention approach which has been set is stored in the storage unit 101 as a meandering prevention approach setting for only approach operation content, and is read by the control unit 100 at the time of start of printing, and control is performed with respect to conveyance and image forming.

Additionally, in an embodiment of the invention, the meandering prevention approach control refers to control for continuing conveyance of continuous paper for a predetermined period of time without performing printing, and in the present embodiment, setting of the predetermined period of time is performed based on the conveyance distance, but the predetermined period of time may be determined in terms of time.

Furthermore, in the case where the automatic button 1402 is selected, the meandering prevention approach is controlled by the control unit 100 based on the meandering prevention approach setting stored in the storage unit 101. At this time, the conveyance condition and the approach operation content regarding the conveyance distance are associated with each other in the meandering prevention approach setting. Examples of the conveyance condition include the type of a job (such as main output, sample printing, an item which can be adjusted even if paper is meandering, etc.), the type of continuous paper, the basis weight, and the like. For example, if the continuous paper is thick paper at or thicker than a first thickness, the continuous paper does not easily meander, and the conveyance distance is made a relatively small distance of 1 m, and if the continuous paper is thin paper at or thinner than a second thickness (first thickness>second thickness), the paper easily meanders, and the conveyance distance is made a relatively great distance of 4 m.

However, the conveyance conditions of the present invention are not limited to those above.

If, during performance of paper meandering prevention approach, adjustment of the machine is allowed or if at the timing, the adjustment can be performed. This allows the amount of paper that is conveyed without being used to be reduced. For example, adjustment of the image forming unit 110 can be performed by forming a patch or a pattern on the intermediate transfer belt and reading the same by the read unit 19. The contents of machine adjustment are not particularly limited in the present invention, and adjustment of an optical system and others are possible. Moreover, during performance of paper meandering prevention approach, adjustment which cannot be performed in a state where paper is meandering (such as position adjustment) is not performed, and such adjustment is performed after the paper meandering is settled.

Furthermore, there is a function of performing, before starting the actual printing, test printing of output images fewer than the actual output images or in a state where the distance on the target paper where printing is to be performed is short. This is called sample printing. In the case of sample printing, since this is not the actual printing, the state of an output image is sometimes simply checked without performing a cut-out process by the processing unit.

In the case of sample printing, sometimes, only the printed result is checked, and the accurate position of transfer on the continuous paper is not checked. In this case, by starting printing even if the continuous paper is meandering, the time before output may be reduced, and wasteful use of paper may be reduced. Sample printing performed in a state where the continuous paper is meandering is shown in FIG. 6.

Figure 6:
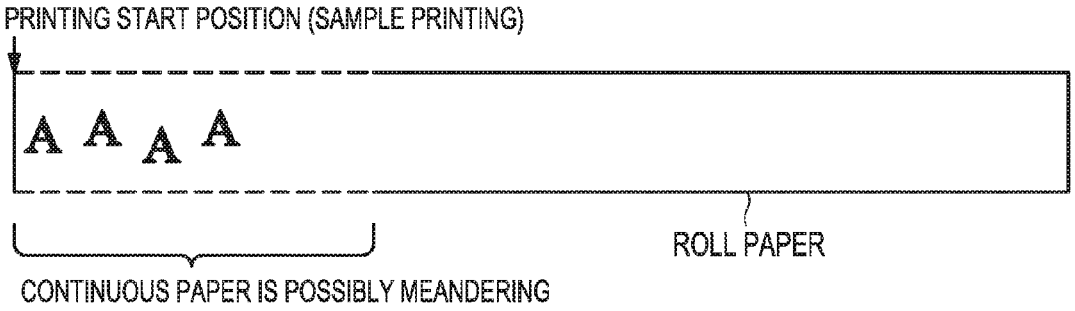
FIG. 6 is a diagram likewise showing a printed state of roll paper where sample printing is performed.

Moreover, in the case of sample printing, it is enough if what is output can be checked, and even if the continuous paper is conveyed in a meandering manner and the position of the image is shifted as shown in FIG. 6, this does not cause any problems, and thus the meandering prevention approach is turned off. In the case of an item which can be adjusted even if the paper is meandering, the meandering prevention approach is performed by the conveyance distance that is based on the type or the basis weight of the continuous paper. Also, at the time of sample printing, the meandering prevention approach may be lessened without being turned off. As the lessening, the approach distance is made shorter than the normal approach distance, or the standard for eliminating the needs for the approach at the time of detection of meandering is relaxed, for example.

Figure 7:
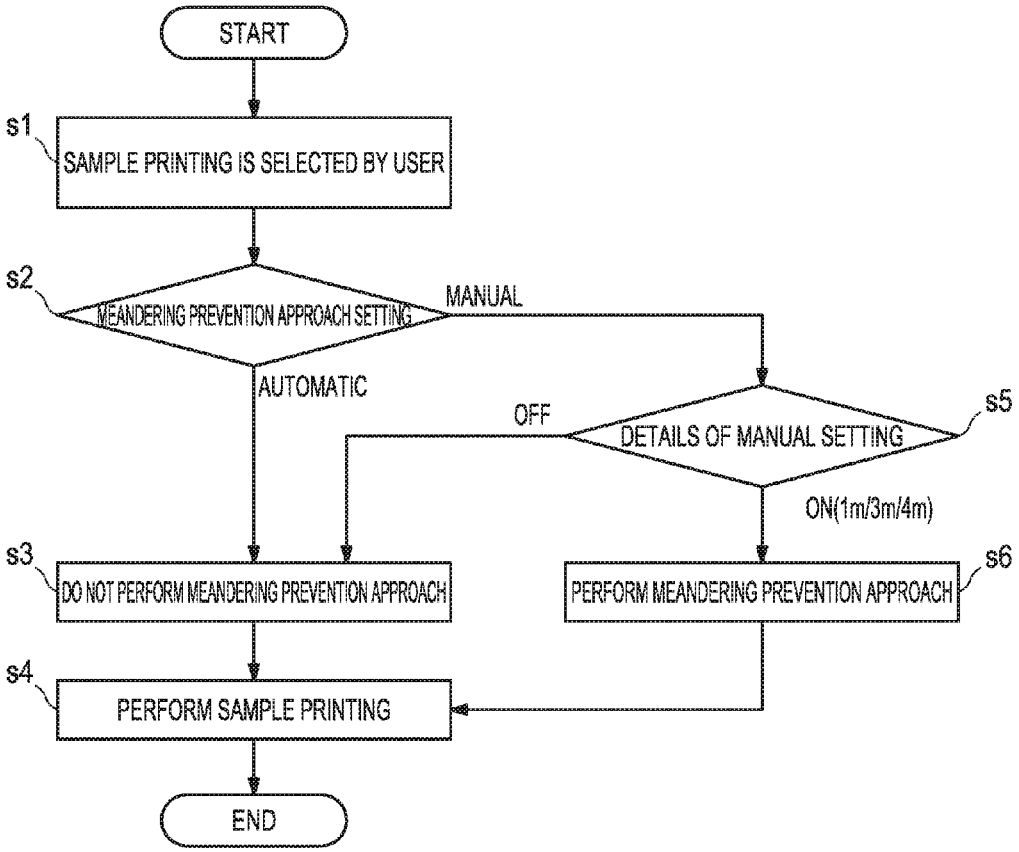
FIG. 7 is a flow chart likewise showing a control procedure where sample printing is selected.

Next, the procedure of printing preparation in a case where a printing job is sample printing will be described with reference to the flow chart in FIG. 7. Additionally, the following procedure is performed under the control of the control unit.

First, upon reception of selection of sample printing by a user (step s1), contents of meandering prevention approach setting are checked (step s2). If the meandering prevention setting is set to automatic (step s2, automatic), the meandering prevention approach is not performed, in accordance with the content of the setting (step s3). At this time, that the meandering prevention approach is not performed can be displayed on the operation display unit 140 to be checked by the user. Also, in sample printing, instead of setting the meandering prevention approach to be not performed, it is possible to have the approach performed by a distance that is shorter (by ½, for example) than the normal distance.

Then, sample printing is performed (step s4), and the procedure is ended.

On the other hand, if the meandering prevention approach is set to manual (step s2, manual), the contents of the manual setting are determined (step s5), and if OFF is set (step s5, OFF), sample printing is performed without performing the meandering prevention approach (steps s3 and 4).

If a conveyance distance is set (step s5, distance setting), the meandering prevention approach is performed based on the set conveyance distance (step s6), and then the procedure is ended.

Figure 8:
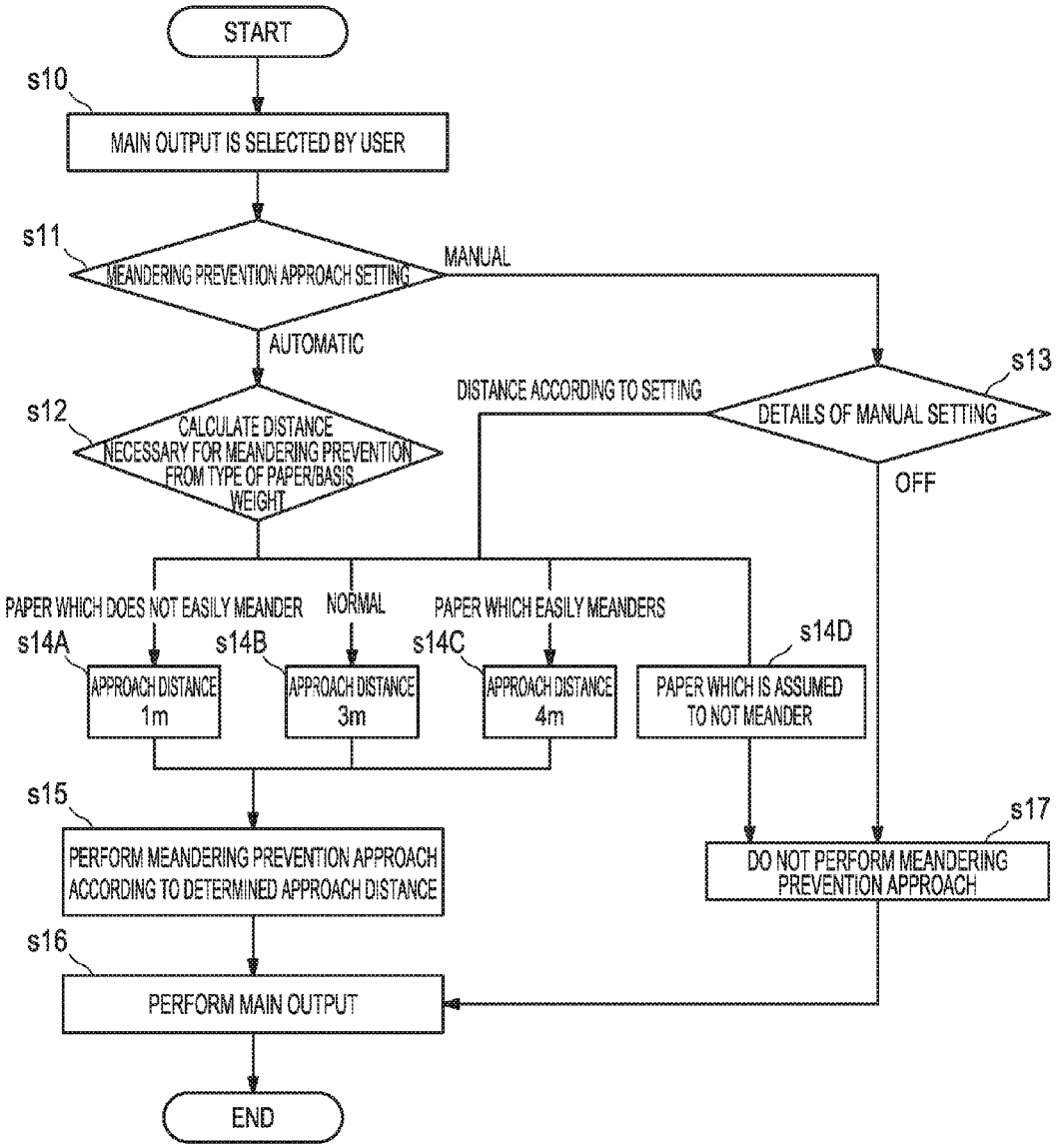
FIG. 8 is a flow chart likewise showing a control procedure where main output is selected.

Next, the procedure of printing preparation in a case where a printing job is main output will be described with reference to the flow chart in FIG. 8. Additionally, the following procedure is performed under the control of the control unit.

First, upon reception of selection of main output by a user (step s10), contents of meandering prevention approach setting are checked (step s11).

If the meandering prevention setting is set to automatic (step s11, automatic), the distance necessary for meandering prevention is calculated based on the details such as the type of paper and the basis weight (step s12).

In the calculation, the approach distance is determined to be 1 m for thick paper which does not easily meander, the normal approach distance to be 3 m, the approach distance to be 4 m for paper which easily meanders, and OFF for paper which is assumed to not meander (steps s14A, s14B, s14C, s14D).

In this case, if paper which does not easily meander (for example, thick paper=high basis weight) is used, the approach distance is made short.

In steps s14A, s14B, and s14C, the meandering prevention approach is performed according to the determined approach distance (step s15), and the main output is performed after the approach is ended (step s16), and the procedure is ended. If OFF is determined, the meandering prevention approach is not performed (step s17), and the main output is performed (step s16).

If the meandering prevention approach setting is set to manual (step s11, manual), details of the manual setting are checked (step s13).

In the case where the manual setting is OFF, the main output is performed assuming in step s17 that the meandering prevention approach is not to be performed (step s16). The approach distance is determined by proceeding, according to the setting, to step s14A in the case of "1 m", to step s145 in the case of "3 m", and to step s14C in the case of "4 m". Next, the meandering prevention approach is performed according to the determined approach distance (step s15), and then the main output is performed (step s16).

In the present example, the approach distance is determined in advance in "automatic", based on the type of paper/basis weight, but the approach can also be performed while checking the actual conveyance state by the edge detection unit 18, and output can be started after it is confirmed that the paper is not meandering.

Figure 9:
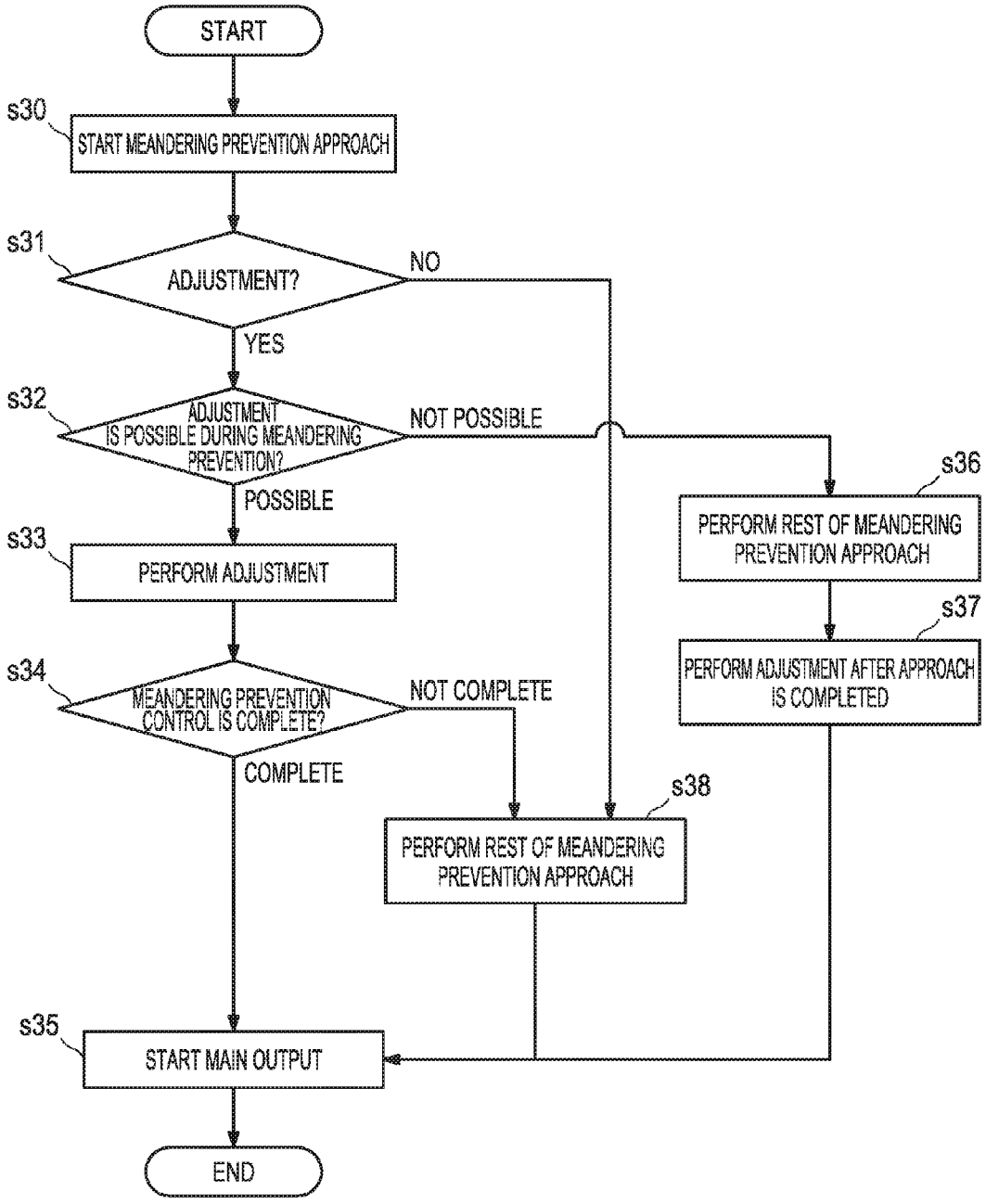
FIG. 9 is a flow chart likewise showing the time of performing machine setting with respect to meandering prevention approach.

Next, the procedure in the case of performing machine adjustment during paper meandering prevention conveyance will be described with reference to the flow chart in FIG. 9. Additionally, the following procedure is performed under the control of the control unit.

After the start, the meandering prevention approach control is started (step s30). Then, whether adjustment is to be performed is determined (step s31), and if there is no adjustment (step s31, no), the rest of the meandering prevention approach is performed (step s38), and the main output is performed after the meandering prevention approach is ended (step s35), and then the procedure is ended.

On the other hand, in the case where adjustment is to be performed (step s31, yes), whether adjustment can be performed during meandering prevention is determined (step s32).

In the case where adjustment can be performed during meandering prevention (step s32, possible), adjustment is performed (step s33), and whether meandering prevention control is complete is determined after adjustment has been performed (step s34).

If the meandering prevention control is complete (step s34, complete), the main output is started (step s35). If the meandering prevention control is not complete (step s34, not complete), the rest of the meandering prevention approach is performed (step s38), and then the main output is started (step s35).

Also, in the case where adjustment is not possible during meandering prevention (step s32, not possible), the rest of the meandering prevention approach is performed (step s36), and adjustment is performed after the approach is complete (step s37). After the adjustment is performed, the main output is started (step s35).

Heretofore, the present invention has been described based on the embodiment described above, but it is also possible to make changes as appropriate within the scope of the present invention.

According to the present invention, the time of start of printing after the start of conveyance of continuous paper can be changed, and reduction in time and reduction in wasteful use of paper can be achieved.

What is claimed is:

1. An image forming device comprising:

an image forming unit for forming an image on continuous paper;

a continuous paper conveying unit for conveying the continuous paper; and a control unit for controlling the image forming unit and the continuous paper conveying unit, wherein, after conveyance is started by the continuous paper conveying unit in printing preparation and before printing is started, the control unit is configured to perform meandering prevention approach control of performing a meandering prevention approach in which the conveyance of the continuous paper is continued for a predetermined distance or for a predetermined period of time without printing being performed on the continuous paper, to stabilize conveyance of the continuous paper that is being conveyed, wherein the control unit is configured to allow at least one of (i) switching between performance and non-performance of the meandering prevention approach, and (ii) changing a level of the meandering prevention approach, and wherein after the conveyance is started by the continuous paper conveying unit with the meandering prevention approach control being performed, the control unit performs the meandering prevention approach control without stopping the conveyance.

2. The image forming device according to claim 1, wherein a time when printing is to be started is at or later than a printing start allowable time that is a time when a conveying speed of the continuous paper conveying unit reaches a predetermined speed.

3. The image forming device according to claim 1, wherein the meandering prevention approach control is control of continuing the conveyance of the continuous paper for the predetermined period of time.

4. The image forming device according to claim 1, wherein the meandering prevention approach control is control of continuing the conveyance of the continuous paper for the predetermined distance.

5. The image forming device according to claim 1, wherein the control unit performs the meandering prevention approach control based on a meandering prevention approach setting.

6. The image forming device according to claim 5, wherein a conveyance condition including at least one of a type of a job, a type of the continuous paper, and basis weight, and an approach operation content regarding the conveyance by the meandering prevention approach are associated with each other in the meandering prevention approach setting.

7. The image forming device according to claim 5, wherein the meandering prevention approach control is control of continuing the conveyance of the continuous paper for the predetermined distance, and wherein, in the meandering prevention approach setting, depending on a conveyance condition, a content regarding the predetermined distance for performing the conveyance in the meandering prevention approach is set as an approach operation content.

8. The image forming device according to claim 5, wherein the meandering prevention approach control is control of continuing the conveyance of the continuous paper for the predetermined distance, and wherein, in the meandering prevention approach setting, the predetermined distance for performing the conveyance in the meandering prevention approach is set according to a thickness of the continuous paper, such that the predetermined distance is smaller for relatively thick continuous paper than for relatively thin continuous paper.

9. The image forming device according to claim 5, wherein the meandering prevention approach setting includes a conveyance condition according to which the meandering prevention approach is not performed.

10. The image forming device according to claim 5, wherein, in a case where a conveyance condition is sample printing, the control unit does not perform the meandering prevention approach or lessens an amount of the conveyance in the meandering prevention approach.

11. The image forming device according to claim 1, wherein the control unit performs machine adjustment during a period of the meandering prevention approach control.

12. The image forming device according to claim 11, wherein, in a case of a condition according to which the machine adjustment is to be performed during the meandering prevention approach control, if the machine adjustment cannot be completed during the period of the meandering prevention approach control, the control unit does not perform the machine adjustment during the period of the meandering prevention approach control, and performs the machine adjustment after the meandering prevention approach is ended.

13. The image forming device according to claim 1, wherein the control unit does not perform machine adjustment regarding a position of the continuous paper and a position of image forming during the conveyance in the meandering prevention approach.

14. The image forming device according to claim 1, further comprising an operation display unit for receiving an operation input, wherein the control unit includes a function of performing the meandering prevention approach control based on an approach operation content set by the operation display unit.

15. The image forming device according to claim 1, further comprising an operation display unit for receiving an operation input, wherein the control unit allows setting, by the operation display unit, performance or non-performance of the meandering prevention approach.

16. The image forming device according to claim 1, wherein the control unit starts printing after performing the conveyance in the meandering prevention approach.

17. An image forming system comprising a control unit for controlling an image forming unit for forming an image on continuous paper and a continuous paper conveying unit for conveying the continuous paper along a conveying path, wherein, after conveyance is started by the continuous paper conveying unit in printing preparation and before printing is started, the control unit is configured to perform meandering prevention approach control of performing a meandering prevention approach in which the conveyance of the continuous paper is continued for a predetermined distance or for a predetermined period of time without printing being performed on the continuous paper, to stabilize conveyance of the continuous paper that is being conveyed, wherein the control unit is configured to allow at least one of (i) switching between performance and non-performance of the meandering prevention approach, and (ii) changing a level of the meandering prevention approach, and wherein after the conveyance is started by the continuous paper conveying unit with the meandering prevention approach control being performed, the control unit performs the meandering prevention approach control without stopping the conveyance.

18. The image forming system according to claim 17, further comprising:

the image forming unit for forming an image on the continuous paper; and the continuous paper conveying unit for conveying the continuous paper along the conveying path.

19. An image forming method of performing printing on continuous paper, the method comprising:

causing conveyance of continuous paper to be started in printing preparation; and performing a meandering prevention approach in which the conveyance of the continuous paper is continued for a predetermined distance or for a predetermined period of time without printing being performed on the continuous paper, to stabilize conveyance of the continuous paper that is being conveyed, after the conveyance of the continuous paper is started and before printing is started, wherein at least one of (i) switching between performance and non-performance of the meandering prevention approach, and (ii) changing of a level of the meandering prevention approach, is allowed to be performed, and wherein after the conveyance of the continuous paper is started with the meandering prevention approach being performed, the meandering prevention approach is performed without stopping the conveyance.

20. The image forming device according to claim 1, wherein the meandering prevention approach control is control of continuing the conveyance of the continuous paper for the predetermined distance, and wherein the control unit selects the predetermined distance from among a plurality of different preset non-zero distances in accordance with an input from a user selecting one of the different plurality of preset non-zero distances.

* * * * *